United States Patent [19]

Murata et al.

[11] Patent Number: 4,660,491

[45] Date of Patent: Apr. 28, 1987

[54] DOUBLE HULL SHIP WITHOUT REINFORCING TRANSVERSE MEMBERS BETWEEN THE INNER AND OUTER HULL PLATINGS

[75] Inventors: Seiichiro Murata; Masaru Tateishi, both of Sakai; Toshio Yoshioka, Kawachi-nagano; Sakito Kamei, Sakai; Hiroshi Nakazono, Arao; Yoshiro Yamawaki, Innoshima, all of Japan

[73] Assignee: Hitachi Zosen Corporation, Osaka, Japan

[21] Appl. No.: 824,557

[22] Filed: Jan. 23, 1986

Related U.S. Application Data

[63] Continuation-in-part of Ser. No. 630,205, Jul. 12, 1984, abandoned.

[30] Foreign Application Priority Data

Jul. 22, 1983 [JP] Japan ..... 58-114506

[51] Int. Cl.[4] ..... B63B 3/20; B63B 3/62

[52] U.S. Cl. ..... 114/65 R; 114/74 R

[58] Field of Search ..... 114/65 R, 65 A, 72, 114/73, 74 R, 74 A

[56] References Cited

U.S. PATENT DOCUMENTS

| | | | |
|---|---|---|---|
| 948,196 | 2/1910 | Watson, Sr. . | |
| 1,127,153 | 2/1915 | Ambrozy . | |
| 1,989,834 | 2/1935 | Watson . | |
| 2,201,047 | 5/1940 | Moore et al. . | |
| 2,364,522 | 12/1944 | Ganteaume . | |
| 2,365,770 | 12/1944 | Nebolsine | 114/65 A |
| 2,405,590 | 8/1946 | Mason . | |
| 2,741,208 | 4/1956 | Albiach | 114/79 |
| 3,085,538 | 4/1963 | Henry | 114/74 |
| 3,109,294 | 11/1963 | Messer | 62/55 |
| 3,199,174 | 8/1965 | Nilsson et al. | 29/55 |
| 3,213,632 | 10/1965 | Valk et al. | 62/54 |
| 3,255,724 | 6/1966 | Campbell et al. | 114/73 |
| 3,356,060 | 12/1967 | Field et al. | 114/125 |
| 3,428,013 | 2/1969 | Prew | 114/74 |
| 3,477,401 | 11/1969 | Hayama | 114/74 |
| 3,498,249 | 3/1970 | Jones | 114/65 A |
| 3,537,415 | 11/1970 | Jackson | 114/74 |
| 3,547,301 | 12/1970 | Ffooks | 114/74 |
| 3,554,152 | 1/1971 | Campbell | 114/125 |
| 3,612,333 | 10/1971 | Cowles | 114/74 A |
| 3,659,543 | 5/1972 | Basile | 114/74 |
| 3,797,099 | 3/1974 | Myers | 114/77 |
| 3,804,050 | 4/1974 | Iarossi | 114/74 A |
| 3,811,593 | 5/1974 | Bridges et al. | 114/74 A |
| 3,834,174 | 9/1974 | Strumbos | 62/47 |
| 3,871,319 | 3/1975 | Turner | 114/65 A |
| 3,875,886 | 4/1975 | Glasfeld et al. | 114/74 A |
| 3,894,505 | 7/1975 | Murphy | 114/84 A |
| 3,899,989 | 8/1975 | Glazebrook | 114/84 |
| 3,922,987 | 12/1975 | Tornay | 114/74 A |
| 3,948,198 | 4/1976 | Yamamoto et al. | 114/74 A |
| 3,978,808 | 9/1976 | Cuneo et al. | 114/74 A |
| 4,066,184 | 1/1978 | Cuthbert et al. | 114/74 A |
| 4,106,424 | 8/1978 | Schuler et al. | 114/74 A |
| 4,228,754 | 10/1980 | Shibata et al. | 114/74 R |
| 4,394,931 | 7/1983 | Cotgreave et al. | 114/74 A |

FOREIGN PATENT DOCUMENTS

| | | | |
|---|---|---|---|
| 90784 | 7/1981 | Japan . | |
| 170148 | 6/1934 | Switzerland . | |
| 936834 | 5/1981 | United Kingdom . | |
| 863595 | 12/1981 | U.S.S.R. | 114/78 |
| 889520 | 12/1981 | U.S.S.R. | 114/78 |

*Primary Examiner*—Sherman D. Basinger

*Attorney, Agent, or Firm*—Barnes, Kisselle, Raisch, Choate, Whittemore & Hulbert

[57] ABSTRACT

A ship according to the present invention comprises an inner hull plating (1) and an outer hull plating (2) connected together solely by transverse bulkheads (4) and connecting longitudinal members (3) fixed to the bulkheads (4). Each bulkhead 4 comprises a rectangular double plate central portion and a rectangular ring form box (11) surrounding the central portion. The box (11) includes a flaring part (11*a*) internally provided with generally triangular ribs (10) and a peripheral part (11*b*) of a constant thickness receiving part of the connecting longitudinal members (3).

1 Claim, 4 Drawing Figures

DOUBLE HULL SHIP WITHOUT REINFORCING TRANSVERSE MEMBERS BETWEEN THE INNER AND OUTER HULL PLATINGS

This is a continuation-in-part of our prior U.S. application Ser. No. 630,205 filed July 12, 1984, now abandoned.

FIELD OF THE INVENTION

The present invention relates to generally steel ships, and more particularly to a double hull structure for tankers and like cargo ships.

BACKGROUND OF THE INVENTION

With a navigating tanker, various forces act on the hull. For example, the hull itself is subjected to a longitudinal bending moment and torsional forces, the outer bottom plating and the outer side plating to the pressure of water, and the inner bottom plating and side wall of the hold (oil tank) to the load of oil cargo under gravity. To withstand these forces, the hull includes a large number of reinforcing members such as longitudinal members (side longitudinal members, bottom longitudinal members, central girder, etc.) extending longitudinally of the ship and transverse members (side transverse members, bottom transverse members, etc.) provided transversely of the ship. In the case of such a structure, however, longitudinal members and transverse members are provided in an intersecting arrangement, so that difficulties are encountered in building the hull by automatic work procedures (e.g. automatic welding). To assure automatic work procedures, therefore, a double hull structure has been proposed which includes no other transverse members besides transverse bulkheads and which comprises an inner hull plating and an outer hull plating connected together only by the transverse bulkheads and connecting longitudinal members fixed to the transverse bulkheads (For simplicity, a ship of such a structure is hereinafter referred to as "transverseless ship", the term "transverseless" in this case meaning the absence of reinforcing transverse members.). In this case, however, forces acting on the inner and outer hull platings are all transmitted to the transverse bulkheads through the connecting longitudinals, so that the proposed structure has problems in respect of strength when the transverse bulkheads are of conventional structure.

SUMMARY OF THE INVENTION

An object of the present invention is to provide a transverseless steel ship having no problem of strength.

To fulfil this object, the present invention provides a steel ship having at least its side portions and bottom portion comprised of an inner hull plating and an outer hull plating connected together by transverse bulkheads and a plurality of connecting longitudinal members fixed to said transverse bulkheads, said inner hull plating extending through said bulkheads, characterized in that (a) there are no other transverse members besides said transverse bulkheads intersecting said connecting longitudinal members, and (b) each transverse bulkhead comprises a substantially rectangular central portion comprising two vertical plates connected together by connecting members arranged therebetween and a substantially rectangular ring form box surrounding said central portion to define a closed space, said box having a flaring part adjoining said central portion and a peripheral part of a substantially constant thickness disposed around said flaring part and partitioned from said flaring part by said inner hull plating, said flaring part of the bulkhead being internally provided with generally triangular ribs spaced apart along the periphery of the bulkhead, part of said connecting longitudinal members being arranged within said peripheral part of the bulkhead.

According to the present invention set forth above, each transverse bulkhead, particularly the ring form box to which the connecting longitudinal members are fixed, is extremely reinforced, so that even when a force acting on the inner and/or outer hull plating is transmitted to the transverse bulkhead through the connecting longitudinal members, the bulkhead fully withstands the force without abnormal bending or buckling.

Further, the transverseless structure of the ship leads to the following advantages.

(1) Absence of reinforcing transverse members decreases the number of components, while absence of intersections between the connecting longitudinal members with reinforcing transverse members makes it possible to build the hull by automatic work procedures (e.g. automatic welding) with a greatly improved efficiency, further facilitating perfect inspection of the space defined by the inner and outer hull platings.

(2) Because the connecting longitudinal members have no intersections with reinforcing transverse members, cracking is avoidable that would otherwise result from stress concentration at such intersections.

(3) Since the spaces defined between the inner and outer hull platings and separated by the transverse bulkheads at large intervals are subdivided only by the connecting longitudinal members, they can be utilized as ballast tanks. Moreover, the ballast tank, which is not divided by reinforcing transverse members longitudinally of the ship drains completely with ease.

(4) Even if a flammable liquid or gas should ingress into spaces between the inner and outer hull platings and between the transverse bulkheads owing to damage to the inner plating, the liquid or gas can be easily drawn off from the spaces to eliminate an explosion hazard since there is no reinforcing transverse members subdividing the spaces longitudinally of the ship.

(5) Absence of reinforcing transverse members facilitates stress analysis for the hull and assures a rational arrangement of components for a weight reduction.

(6) The double hull structure prevents outflow of cargo oil in the event of a collision with other ship or stranding.

Various features and advantages of the present invention will become apparent from the following description of an embodiment with reference to the accompanying drawings.

DETAILED DESCRIPTION

Figure 1:
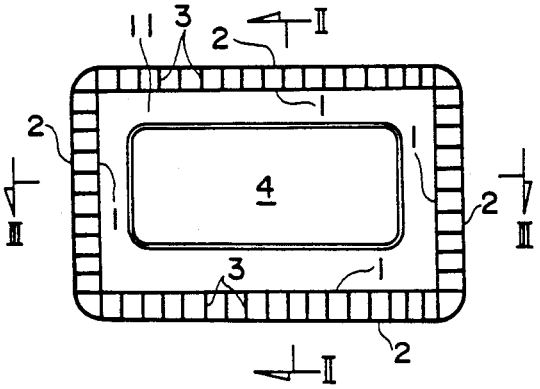
FIG. 1 is a diagram in transverse section showing a transverseless ship embodying the invention.
Figure 2:
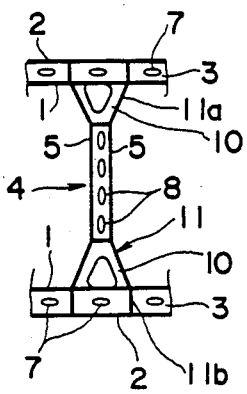
FIG. 2 is a diagram in section taken along the line II—II in FIG. 1.
Figure 3:
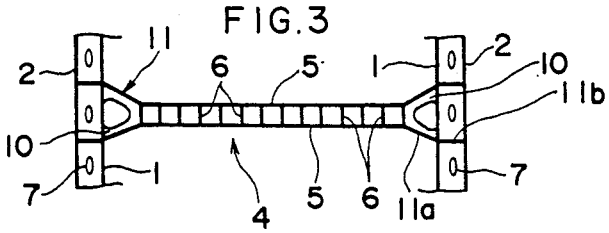
FIG. 3 is a diagram in section taken along the line III—III in FIG. 1.

Referring to FIGS. 1 to 4, the transverseless steel ship comprises a deck portion, a bottom portion and opposite side portions each having a double shell structure. The structure comprises an inner hull plating 1 and an outer hull plating 2 which are connected together by connecting longitudinal members 4. Both hull platings 1 and 2 are further interconnected by transverse bulkheads 4 (only one illustrated) spaced apart longitudinally of the ship. There are no other transverse members besides the bulkheads 4. The hull plating 1 extends through the bulkheads 4, and the connecting longitudinal members 3 are fixed to the bulkheads 4. The connecting longitudinal members 3 have weight reduction holes 7.

Figure 4:
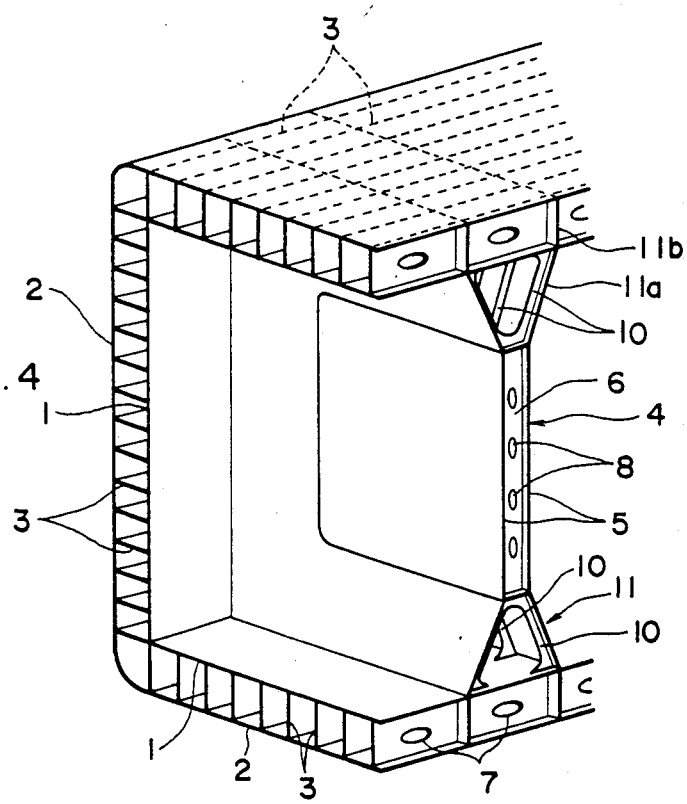
FIG. 4 is a perspective view of the ship with part thereof taken away.

As best illustrated in FIG. 4, each transverse bulkhead 4 has a rectangular central portion comprising a pair of vertical plates 5 connected together by connecting members 6 extending in the direction of the height of the ship in parallel to each other, and a box 11 in the form of a rectangular ring surrounding these vertical plates 5 to define a closed interior space. The box 11 includes a flaring part 11*a* adjoining the central vertical plates 5 and a peripheral part 11*b* of a constant thickness or width disposed around the flaring part 11*a* and separated therefrom by the inner hull plating 1. The flaring part 11*a* is internally provided with generally triangular ribs 10 spaced along the periphery of the bulkhead 4. Part of the connecting longitudinal members 3 is positioned within the peripheral part 11*b* of the bulkhead 4. Indicated at 8 are weight reduction holes provided for the vertical connecting members 6.

The transverse bulkhead 4 thus reinforced can effectively withstand various forces transmitted through the connecting longitudinal members 3 or the hull platings 1 and 2. While navigating with a liquid loaded in the hold defined by two adjacent transverse bulkheads 4 and a space left unoccupied above the load, the ship will pitch or roll, sloshing the liquid and causing the liquid to strike against the bulkhead 4. In such an event, the liquid flowing toward the upper corner of the hold, without being restrained from further movement, is guided smoothly along the slanting surface of the bulkhead flaring part 11*a* positioned immediately below the deck. Consequently the upper corner of the hold will not be subjected to a great force and can be prevented from cracking due to stress concentration. The interior space of the bulkhead flaring part 11*a* can be utilized as a passage for workers or is usable for the installation of pumps, etc.

What is claimed is:

1. A steel ship having at least its side portions and bottom portion comprised of an inner hull plating and an outer hull plating connected together by transverse bulkheads and a plurality of connecting longitudinal members fixed to said transverse bulkheads, said inner hull plating extending through said bulkheads, characterized in that (a) said longitudinal members are disposed perpendicularly both to the inner and outer hull platings, and (b) there are no other transverse members besides said transverse bulkheads intersecting said connecting longitudinal members, and (c) each transverse bulkhead comprises a substantially rectangular central portion comprising two vertical plates connected together by connecting members arranged therebetween and a substantially rectangular ring form box surrounding said central portion to define a closed space, said box having a flaring part adjoining said central portion and a peripheral part of a substantially constant thickness disposed around said flaring part and partitioned from said flaring part by said inner hull plating, said flaring part of the bulkhead being internally provided with generally triangular ribs spaced apart along the periphery of the bulkhead, part of said connecting longitudinal members being arranged within said peripheral part of the bulkhead.

* * * * *